US006724310B1

(12) United States Patent
Gershenfeld et al.

(10) Patent No.: US 6,724,310 B1
(45) Date of Patent: Apr. 20, 2004

(54) FREQUENCY-BASED WIRELESS MONITORING AND IDENTIFICATION USING SPATIALLY INHOMOGENEOUS STRUCTURES

(75) Inventors: Neil Gershenfeld, Somerville, MA (US); Richard Fletcher, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/685,819

(22) Filed: Oct. 10, 2000

(51) Int. Cl.[7] ..... G08B 13/14

(52) U.S. Cl. ..... 340/572.4; 340/572.1; 340/572.2; 340/572.5

(58) Field of Search ..... 340/572.1, 572.2, 340/572.4, 572.5

(56) References Cited

U.S. PATENT DOCUMENTS

| | | | | | |
|---|---|---|---|---|---|
| 3,967,161 | A | | 6/1976 | Lichtblau | 317/101 |
| 4,074,249 | A | | 2/1978 | Minasy | 340/280 |
| 4,075,618 | A | | 2/1978 | Montean | 340/280 |
| 4,484,184 | A | | 11/1984 | Gregor et al. | 340/572 |
| 4,510,489 | A | | 4/1985 | Anderson, III et al. | 340/572 |
| 4,578,654 | A | | 3/1986 | Tait | 333/175 |
| 4,598,276 | A | | 7/1986 | Tait | 340/572 |
| 4,658,264 | A | | 4/1987 | Baker | 343/895 |
| 4,818,312 | A | | 4/1989 | Benge | 156/52 |
| 5,119,070 | A | | 6/1992 | Matsumoto et al. | 340/572 |
| 5,381,137 | A | * | 1/1995 | Ghaem et al. | 340/572.4 |
| 5,446,447 | A | * | 8/1995 | Carney et al. | 340/572 |
| 5,565,849 | A | | 10/1996 | Ho et al. | 340/572 |
| 5,604,485 | A | | 2/1997 | Lauro et al. | 340/572 |
| 5,608,417 | A | * | 3/1997 | De Vall | 340/572 |
| 5,650,236 | A | | 7/1997 | Hirano et al. | 428/611 |
| 5,729,201 | A | | 3/1998 | Jahnes et al. | 340/572 |
| 5,821,859 | A | | 10/1998 | Schrott et al. | 340/572 |
| 5,902,437 | A | * | 5/1999 | McDonough et al. | 340/572 |
| 6,025,725 | A | | 2/2000 | Gershenfeld et al. | 324/652 |
| 6,031,458 | A | * | 2/2000 | Jacobsen et al. | 340/572 |
| 6,067,002 | A | * | 5/2000 | Jujino et al. | 336/200 |
| 6,087,940 | A | * | 7/2000 | Caperna et al. | 340/572.5 |

* cited by examiner

*Primary Examiner*—Jeffery Hofsass
*Assistant Examiner*—Hung Nguyen
(74) *Attorney, Agent, or Firm*—Testa, Hurwitz & Thibeault, LLP

(57) ABSTRACT

Wireless tags have a plurality of non-equivalent current pathways, each of which responds differently to an interrogation signal and collectively represent encoded information. The element is subjected to the signal, stimulating the current pathways, each of which contributes to an overall element response. The individual contributions and, hence, the information may be recovered from this overall response. The response of each of the pathways to the signal may vary in terms of one or more of resonant frequency, amplitude, damping, and Q factor.

49 Claims, 4 Drawing Sheets

FREQUENCY-BASED WIRELESS MONITORING AND IDENTIFICATION USING SPATIALLY INHOMOGENEOUS STRUCTURES

FIELD OF THE INVENTION

The present invention relates to remote sensing, tracking, and identification, and in particular to the production and use of inexpensive ID "tags."

BACKGROUND OF THE INVENTION

Various monitoring technologies are known and used to monitor the location of an article or to provide identification in a wide range of contexts. One such technology, known as "tagging," is commonly employed, for example, in shoplifting security systems, security-badge access systems and automatic sorting of clothes by commercial laundry services. Conventional tagging systems may use some form of radio-frequency identification (RF-ID). In such systems, RF-ID tags and a tag reader (or base station) are separated by a small distance to facilitate near-field electromagnetic coupling therebetween. Far-field radio tag devices are also known and used for tagging objects at larger distances (far-field meaning that the sensing distance is long as compared to the wavelength and size of the antenna involved).

The near-field coupling between the RF-ID tag and the tag reader is used to supply power to the RF-ID tag (so that the RF-ID tag does not require a local power source) and to communicate information to the tag reader via changes in the value of the tag's impedance; in particular, the impedance directly determines the reflected power signal received by the reader. The RF-ID tag incorporates an active switch, packaged as a small electronic chip, for encoding the information in the RF-ID tag and communicating this information via an impedance switching pattern. As a result, the RF-ID tag is not necessarily required to generate any transmitted signal.

Even though RF-ID tags have only a small and simple electronic chip, they are relatively complex devices requiring sophisticated manufacturing techniques to produce. A simpler alternative involves marker elements adapted to affect an interrogation signal in a measurable, characteristic way. Many such systems utilize magnetic or magnetomechanical tags. For example, a magnetic wire or strip exhibiting harmonic behavior may be stimulated within an interrogation zone by transmitter antenna coils. The coils generate an alternating magnetic interrogation field, which drives the marker into and out of saturation, thereby disturbing the interrogation field and producing alternating magnetic fields at frequencies that represent harmonics of the interrogation frequency. The harmonics are detected by receiver antenna coils, which may be housed in the same structure as the transmitter coils. Accordingly, the appearance of a tagged article within the zone—which may be defined, for example, near the doors of a retail store or library—is readily detected.

While inexpensive, magnetic antitheft systems tend to encode very little, if any, information. Essentially, the tag merely makes its presence known. Although some efforts toward enhancing the information-bearing capacity of magnetic tags have been made-see, e.g., U.S. Pat. Nos. 5,821,859; 4,484,184; and 5,729,201, which disclose tags capable of encoding multiple bits of data—the tags themselves tend to be complex and therefore expensive to produce, and may require special detection arrangements that limit the interrogation range (the '859 patent, for example, requires scanning a pickup over the tag) or involve specialized equipment.

DESCRIPTION OF THE INVENTION

Brief Summary of the Invention

In U.S. Ser. No. 09/617,249 (filed on Jul. 14, 2000), commonly owned with the present application and incorporated by reference herein, we disclosed tags having information-encoding spatial inhomogeneities that may be detected in the time domain; in effect, characteristics in space are transformed into time for sensing purposes. We have also found that spatial homogeneities can be detected and resolved in the frequency domain. This "space-into-frequency" approach can be preferable, for example, when simultaneously interrogating multiple tags, and may also afford less implementational complexity (since circuit timing is not critical, and fabrication techniques for the tags themselves is straightforward). In any case, the present invention represents an alternative approach to remotely deriving information that has been spatially encoded.

Tags in accordance with the present invention may be very inexpensively produced yet carry appreciable quantities of data. Unlike the prior art, which requires specialized information-bearing structures, the present invention can utilize simple physical modifications to, or externally applied field biases operating on, materials that are easily procured.

In general, the present invention utilizes structures, preferably small in overall dimension, that exhibit multiple resonances at frequencies conveniently detectable through wireless broadcast. Thus, in one aspect, the invention facilitates sensing of information using an element responsive to a wireless electromagnetic signal. The element may have a plurality of non-equivalent current pathways, each of which responds differently to the signal and collectively represent the information. The element is subjected to the wireless electromagnetic signal, stimulating the current pathways, each of which contributes to an overall element response. The individual contributions and, hence, the information may be recovered from this overall response.

The response of each of the pathways to the signal may vary in terms of, e.g., one or more of resonant frequency, amplitude, damping, and Q factor. For example, each of the pathways may correspond to a different capacitance and/or to a different inductance.

It should be stressed that frequency response has been employed in prior systems to facilitate tag detection, but in a manner very different from that described herein. For example, prior-art surveillance systems based on magnetoelastic materials utilize only the fundamental mechanical resonance frequency of the marker. A representative marker includes one or more strips of a magnetoelastic material packaged with a magnetically harder ferromagnet (i.e., one with a higher coercivity) that provides a biasing field to establish peak magnetomechanical coupling. The mechanical resonance frequency of the marker is dictated essentially by the length of the strip(s) and the biasing field strength. When subjected to an interrogating signal tuned to this resonant frequency, the marker responds with a large signal field that is detected by a receiver. The size of the signal field is partially attributable to an enhanced magnetric permeability of the marker material at the resonance frequency.

In other prior-art systems, the marker is excited into oscillations by signal pulses, or bursts, generated at the marker's resonant frequency by a transmitter. When an exciting pulse ends, the marker undergoes damped oscillations at its resonant frequency (i.e., the marker "rings down"), and this response (ring down) signal is detected by a receiver. Accordingly, prior systems generally involve a single resonant frequency dictated by the entire tag structure, and a uniform bias field. Multibit information encoded spatially cannot be recovered based on frequency response.

Indeed, an important advantage of the invention derives not only from the ability to obtain multiple resonances, but from the more general relationship between the amount of information that can be encoded on a tag and its physical complexity. If, for example, the amount of encodable information is determined by the number of resonant frequencies a tag exhibits, then the tag's information-bearing capacity will grow much faster than its physical complexity, since each additional resonance requires only modest additional tag features. This means that linear increases in complexity (and, therefore, difficulty of fabrication) will produce substantially larger (e.g., exponential) increases in information-bearing capacity, rendering the present invention highly scalable and efficient.

In a second aspect, the invention comprises an information-bearing structure having multiple, non-equivalent pathways for electrical current. Each pathway encodes information recoverable by means of a wireless electromagnetic signal. Such a structure may, for example, take the form of a pair of conductive loops with one or more conductive crossbars extending thereacross, or a pair of matched conductive patterns forming one or more broken loops.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1A:
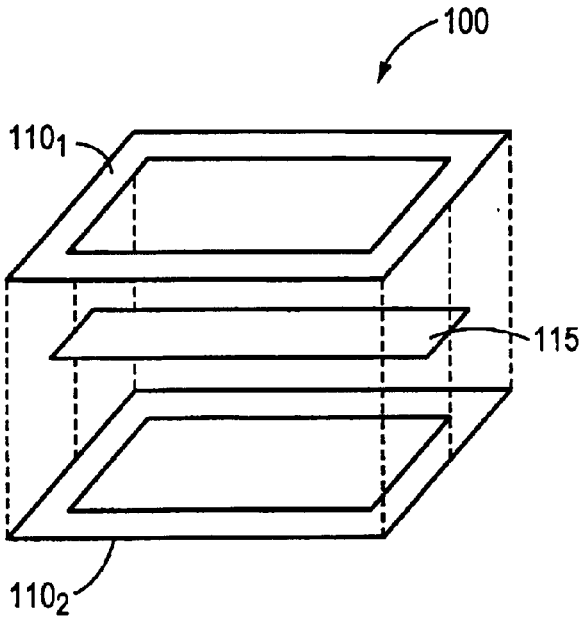
FIGS. 1A–1C depict the structure of a representative crossbar embodiment of the present invention.

In a first embodiment, illustrated generally at 100, the invention achieves multiple, non-equivalent, wirelessly stimulated current pathways using a pair of conductive loops $\mathbf{110}_1$, $\mathbf{110}_2$ and a conductive crossbar 115 spanning the loops. As shown in FIGS. 1A and 1C, the conductive elements $\mathbf{110}_1$, $\mathbf{110}_2$, 115 are separated by a pair of dielectric spacers $\mathbf{120}_1$, $\mathbf{120}_2$ (which may be, for example, plastic, rubber, paper, or other suitable material). Conductive loops $\mathbf{110}_1$, $\mathbf{110}_2$ are electrically connected as shown. The structure 100 exhibits both inductance and capacitance, and may be represented by the circuit 122 shown in FIG. 1D. In particular, the two loops $\mathbf{110}_1$, $\mathbf{110}_2$ give rise to an inductance 125 and a capacitance 130; and capacitive coupling through crossbar 115 results in two additional current loops (see FIG. 1B), each giving rise to a separate capacitance 135, 137 and a combined inductance 140. (Not shown is the intrinsic material resistance, which contributes, albeit marginally, to the response of structure 100.)

Figure 1B:
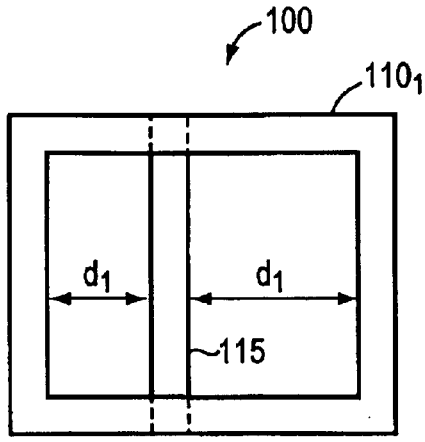
Figure 1C:
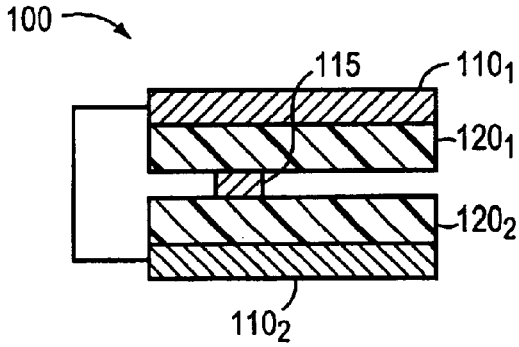

When subjected to an interrogation field, structure 100 exhibits a single resonance peak whose frequency and quality (Q) factor depend on the overall dimensions of structure 100 and the location of crossbar 115 (i.e., with reference to FIG. 1B, the relative distances $d_1$, and $d_2$). Thus, the configuration of structure 100 can be deduced from the resonant frequency and/or Q, so the location of crossbar 115 in effect determines a remotely readable identity for the structure.

More specifically, a continuous-wave ac input signal (which may range, for example, from 1–500 MHz, but which is typically on the order of 50 MHz) may be applied to the input port of an interrogation coil by a conventional sweep generator or the like. When placed within the range of the interrogation coil, structure 100 changes the reflected power returning to the input port—that is, the loading (at near-field coupling distances) or backscatter (for far-field coupling). The maximum operating distance between the resonator package and the interrogation antenna is approximately twice the maximum dimension of the interrogation antenna. The reflected power reaches a minimum at the resonant frequency of structure 100.

Alternatively, the reading circuitry may have a two-port configuration including a transmitting coil and a receiving coil. The structure 100 changes the transmitted power from the transmitting to the receiving coil. If the coupling between transmitting and receiving coils is low, the transmitted voltage will have a maximum at the resonant frequency.

Figure 1D:
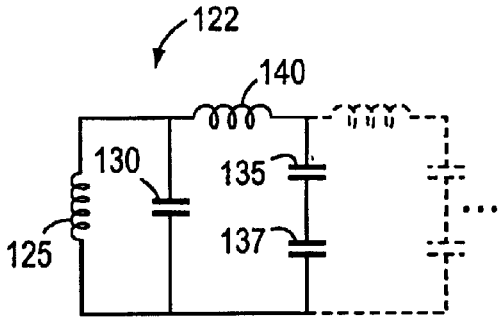
FIG. 1D is an electrical schematic corresponding to the embodiment shown in FIGS. 1A–1C.
Figure 1E:
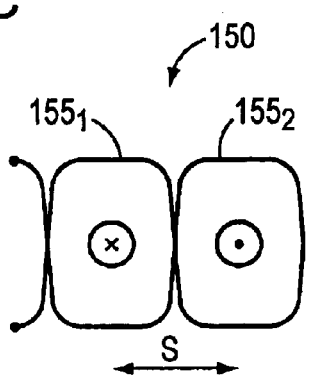
FIG. 1E shows an excitation antenna useful in conjunction with the embodiment shown in FIGS. 1A–1C.

Adding additional crossbars 115 results in production of further, discrete resonant frequencies (that is, the resonances do not coalesce but instead remain separate). As shown in FIG. 1D, this is due to the effective addition of further circuit elements; each new crossbar introduces a new inductance and set of capacitances analogous to (and in parallel with) elements 135, 137, 140. In the case of multiple-crossbar structures, the number of resonant frequencies, the frequencies themselves, their amplitudes, and the associated Q factors all represent variables that may be manipulated. The resonant frequency may be directly affected through the widths and placement of the crossbars (i.e., their distances from the edges of the loop). The Q of the structure 100 depends on energy loss, and is therefore affected by the conductivity of elements $\mathbf{110}_1$, $\mathbf{110}_2$, 115 and the energy loss through dielectric material $\mathbf{120}_1$, $\mathbf{120}_2$. The amplitude of the resonance peak depends on the Q factor and the degree of inductive coupling between the excitation signal and the structure 100.

Any of these parameters can be varied in order to encode multiple bits of information for each resonance peak; conversely, the information encoded in the geometry of the structure may be deduced from the frequency response. Such information may for example, identify a particular structure 100 and distinguish it from others. The amount of information that may be represented by the structure 100—that is, the number of effective degrees of freedom—depends on the detection resolution at a given degree of required reliability; if the detector is unable to consistently discriminate between different parameter values under typical operating conditions, those values are not separable and cannot encode distinct information (i.e., represent effective degrees of freedom). For example, amplitude may be varied among different structures through the use of different conductive and/or dielectric materials. At a gross level of variability, a structure 100 may provide a "high" or a "low" amplitude response, thereby associating a binary digit of information with each resonance peak. If the system can reliably discriminate among multiple amplitude levels, more bits of information per peak may be encoded.

With reference to FIG. 1D, a representative excitation antenna 150 for interrogating structure 100 includes a series of loops representatively shown at $\mathbf{155}_1$, $\mathbf{155}_2$. The magnetic fields produced by the loops $\mathbf{155}_1$, $\mathbf{155}_2$ have opposite orientations as shown. Thus, the distance s between loop centers is desirably on the order of the average crossbar spacing (e.g., with reference to FIG. 1B, on the order of $$\frac{d_1 + d_2}{2}.$$

The number of loops 155 should be equal to (or exceed) the maximum number of crossbars that might be associated with a structure 100 to be read.

The structure 100 is placed in proximity to the antenna 150, and as the loops 150 roughly align with the loops formed on either side of the crossbar 115 in structure 100, the resonances are detected with a good degree of precision.

Figure 2A:
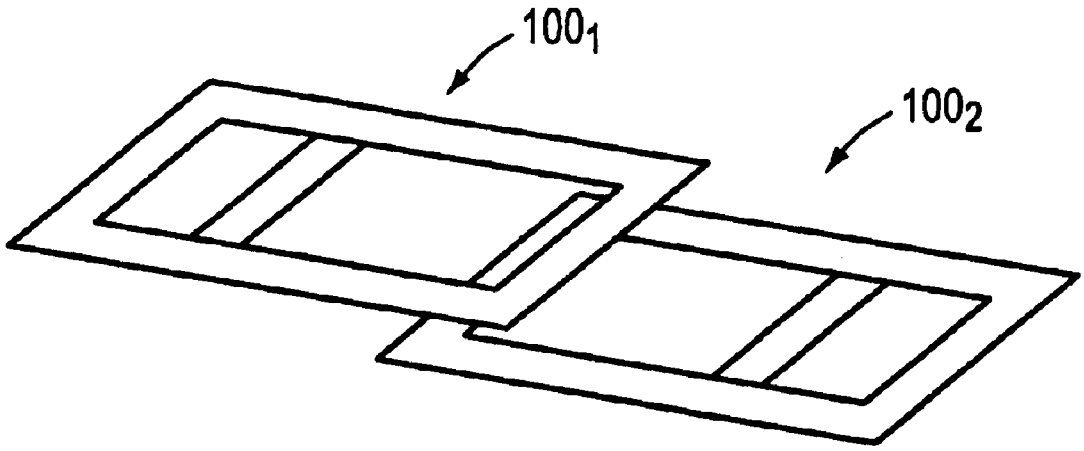
FIG. 2A depicts capacitive coupling between two crossbar structures.

As noted above, the information borne by structure 100 may be increased by adding crossbars. Alternatively, information capacity can be increased by combining multiple structures 100. As shown in FIG. 2A, a pair of structures $\mathbf{100}_1$, $\mathbf{100}_2$ are overlaid in a spaced-apart fashion such that they overlap spatially at one loop arm; the result is, in effect, a capacitive link between two distinct circuits 122. A dielectric material intervenes between the structures $\mathbf{100}_1$, $\mathbf{100}_2$, and the degree of capacitive coupling—and therefore the resonance behavior of the combined system—depends on the nature of that dielectric material, the spacing between the structures, and the degree of overlap. In general, the resonance peaks associated with each structure $\mathbf{100}_1$, $\mathbf{100}_2$ will be preserved when the combined structure is interrogated.

Figure 2B:
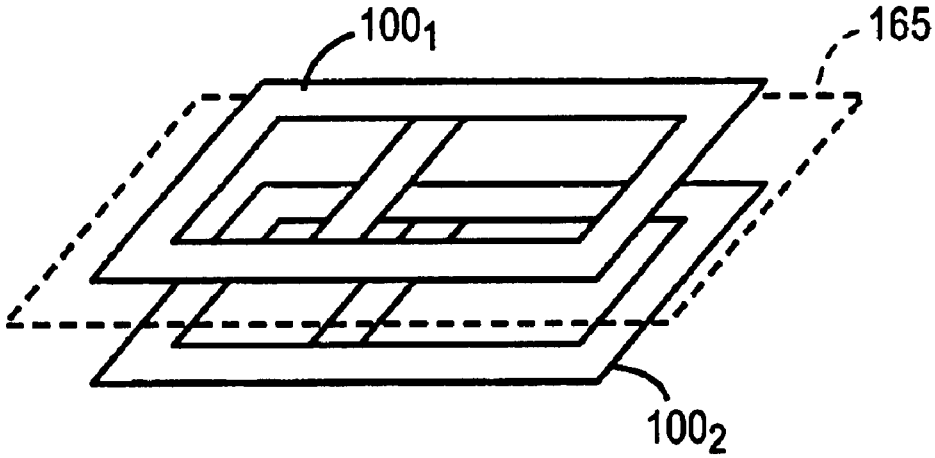
FIG. 2B depicts inductive coupling between two crossbar structures.

If the structures $\mathbf{100}_1$, $\mathbf{100}_2$ are overlaid (and separated by a dielectric spacer 165, which may be a dielectric sheet or an air layer) so that they overlap substantially or congruently, as shown in FIG. 2B, they will couple inductively as well as capacitively. Once again, although the resonant frequencies may shift as a result of coupling, they will remain separately detectable.

Figure 3A:
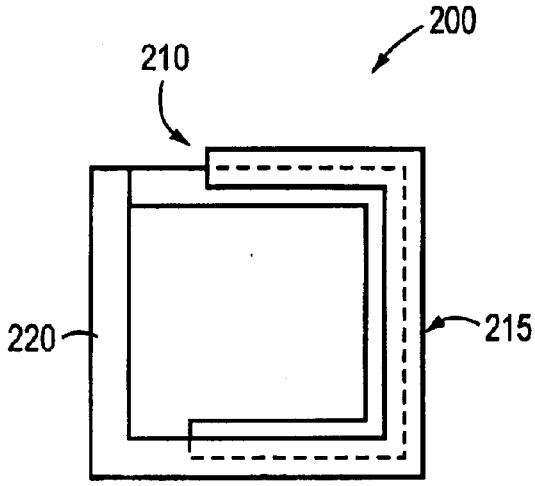
FIGS. 3A and 3B depict the structure of a representative broken-loop embodiment of the present invention.
Figure 3B:
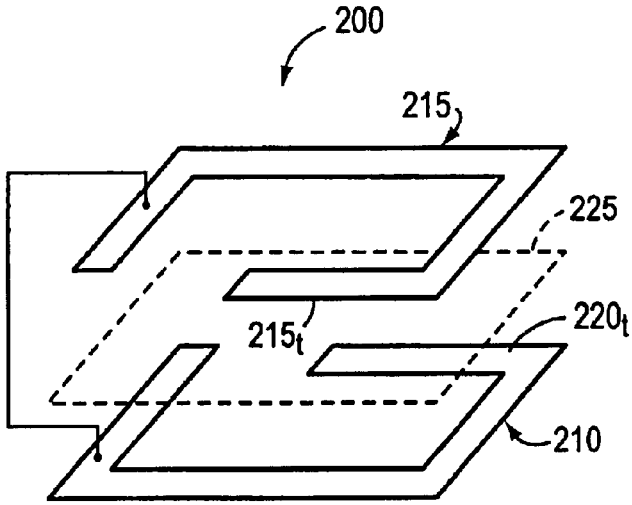

A second embodiment of the invention, the basic form of which is illustrated in FIGS. 3A and 3B and denoted generally at 200, utilizes a pair of overlapping partial loops 210, 215 that share a backbone current path, e.g., in the form of a common leg 220. As shown in the schematic representation of FIG. 3B, the partial loops 210, 215 are opposed so as to overlap spatially and are separated (where not joined) by a dielectric spacer 225. Once again, the structure 200 forms an LC tank circuit with a resonant frequency and Q factor determined by the overall dimensions of the loops 210, 215. In particular, the frequency of the peak depends on the overlap area (i.e., capacitance) between loops 210, 215 and the diameter of the loop (i.e., inductance). It is therefore possible to vary the frequency by altering the lengths of the terminal legs 215*t*, 220*t*; shorter terminal legs will decrease capacitance and, to a lesser extent, inductance, raising the resonant frequency. Accordingly, it is possible to manufacture a single basic structure and vary its detectable identifying frequency by selectively trimming legs 215*t*, 220*t*. The number of separately identifiable structures that may be created in this manner depends on the amplitude of the peaks, the degree of coupling, and the sensitivity of the detection circuitry—that is, on the ability to reliably discriminate between different structures based on the detected response. Once again, peak amplitude depends on the conductivity of the loops 210, 215 (which are typically metal foil) and the loss through dielectric material 225.

Figure 3C:
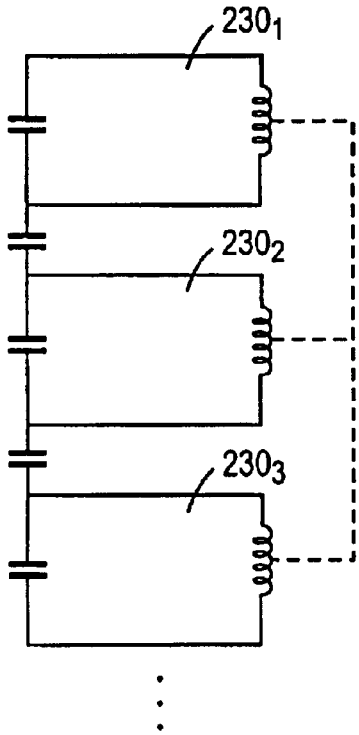
FIG. 3C is an electrical schematic corresponding to the embodiment shown in FIGS. 3A and 3B.

To obtain additional resonant frequencies, two or more structures 200 may be stacked (with overlying loops separated by dielectric spacers). The resulting is shown in FIG. 3C. Each structure 200 is represented by one of the tank circuits $\mathbf{230}_1$, $\mathbf{230}_2$, $\mathbf{230}_3$, which are capacitively and inductively coupled as shown. Once again the resonances associated with each structure is preserved in the combination—that is, while the frequency may shift, the degree of shift (if any) will likely be similar for all frequencies, and in any case the resonances will remain separately detectable.

Figure 4A:
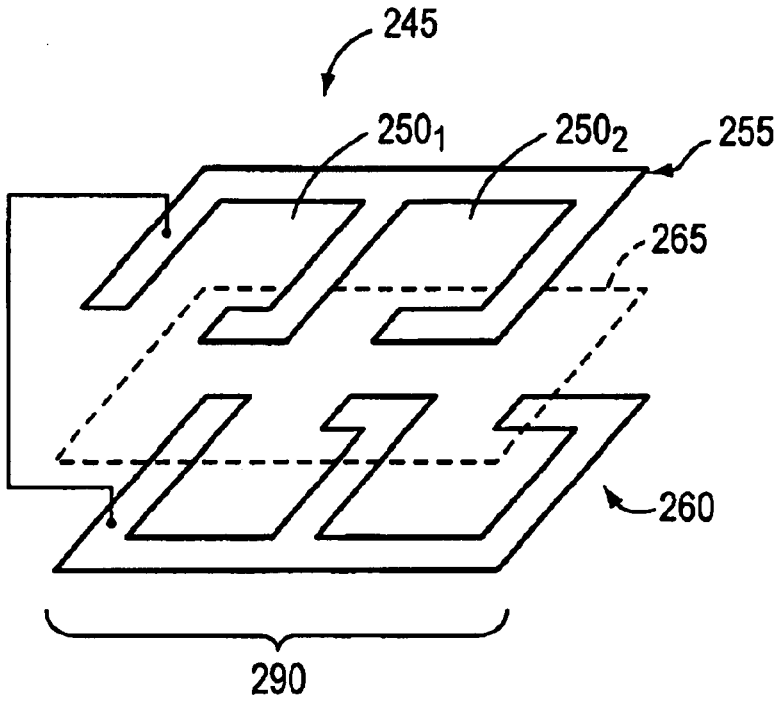
FIG. 4A shows a broken-loop embodiment of the present invention containing a plurality of loops.

The information carried by each structure 200 may be expanded by increasing the number of partial loops in the structure. One approach, illustrated in FIG. 4A and indicated at 245, essentially replicates the loops in an adjacent, sequential fashion. Although two partial loops $\mathbf{250}_1$, $\mathbf{250}_2$ are shown, it should be understood that the structure may contain as many partial loops as desired for purposes of representing information. Once again, the loops are formed by complementary conductive (e.g., metal foil) segments 255, 260, which are electrically connected (and generally joined) along one edge. The loops of segment 225 have a turn direction opposite to that of the segment 260 loops. A dielectric medium 265 intervenes between the segments 255, 260 where these are not joined, and the entire structure 245 may therefore be relatively flat.

Figure 4B:
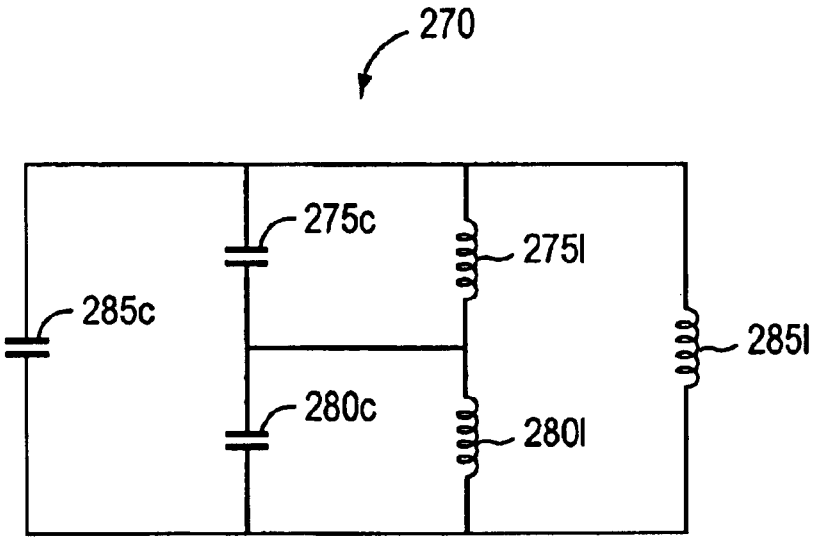
FIG. 4B is an electrical schematic corresponding to the embodiment shown in FIG. 4A.

An equivalent electrical circuit 270 is illustrated in FIG. 4B. The circuit includes three LC resonators represented by a first capacitor 275*c* and inductor 275*l*, coresponding to one of the partial loops $\mathbf{250}_1$, $\mathbf{250}_2$; a second capacitor 280*c* and inductor 280*l*, corresponding to the other partial loop $\mathbf{250}_1$, $\mathbf{250}_2$; and a third capacitor 285*c* and inductor 285*l*, corresponding to the large partial loop indicated at 290 (FIG. 4A) and extending from the connected leg of the structure 245 to the terminal legs on the opposite end.

Each of these loops gives rise to a separately detectable resonance peak, which may be adjusted, once again, by altering the dimensions of the structure 245 and, more finely, by varying the lengths of the various terminal legs as discussed above. Since the structure 245 is associated with three distinct resonances, it can encode three times as much information as the single-loop structure shown in FIGS. 3A and 3B. Adding a further partial loop adds a further resonance peak, along with the effective degrees of freedom that implies.

It will therefore be seen that the foregoing represents an inexpensive and versatile approach to encoding information for external sensing. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of sensing information, the method comprising:

a. providing a device responsive to a wireless electromagnetic signal and having plurality of non-equivalent current pathways, each of the pathways responding differently to the signal and collectively representing the information, wherein the device comprises a pair of parallel, electrically conductive loops and at least one conductive crossbar sandwiched therebetween, with a dielectric material intervening between the at least one crossbar and the loops;

b. subjecting the device to the wireless electromagnetic signal; and c. recovering the information based on interaction between the device to the signal.

2. The method of claim 1 wherein each of the pathways exhibits a different electrical response to the signal, the responses characterizing the information and differing in at least one of resonant frequency, amplitude, damping, and Q factor.

3. The method of claim 2 wherein each of the pathways corresponds to a different capacitance.

4. The method of claim 2 wherein each of the pathways corresponds to a different inductance.

5. The method of claim 1 wherein the device has at least two conductive crossbars.

6. The method of claim 5 wherein each crossbar has a position relative to the loops, each crossbar position contributing to a resonant frequency of the device.

7. The method of claim 5 wherein each crossbar has a width, each crossbar width contributing to a resonant frequency and a Q factor at that frequency.

8. The method of claim 5 wherein:

a. the crossbars have an average spacing therebetween; and b. subjection comprises generating the electromagnetic signal and sending the signal through an antenna, the antenna comprising a series of loops having an average size approximating the average spacing between crossbars.

9. The method of claim 1 further comprising:

a. providing a second device responsive to a wireless electromagnetic signal and having plurality of non-equivalent circuit pathways, each of the pathways responding differently to the signal and collectively representing additional information, wherein the second device comprises a pair of electrically conductive loops and a conductive crossbar sandwiched therebetween, with a dielectric material intervening between the crossbar and the loops; and b. electrically coupling the devices so as to facilitate joint detection of the information and the additional information.

10. The method of claim 9 wherein the devices are coupled at least capacitively.

11. The method of claim 9 wherein the devices are coupled at least inductively.

12. A device responsive to a wireless electromagnetic signal and having a plurality of non-equivalent current pathways representing information, each of the pathways responding differently to the signal to convey the information, wherein the non-equivalent current pathways comprise a pair of parallel, electrically conductive loops and at least one conductive crossbar sandwiched therebetween, with a dielectric material intervening between the at least one crossbar and the loops.

13. The device of claim 12 wherein each of the pathways exhibits a different electrical response to the signal, the responses characterizing the information and differing in at least one of resonant frequency, amplitude, damping, and Q factor.

14. The device of claim 13 wherein each of the pathways corresponds to a different capacitance.

15. The device of claim 13 wherein each of the pathways corresponds to a different inductance.

16. The device of claim 12 wherein the device has at least two conductive crossbars.

17. The device of claim 16 wherein each crossbar has a position relative to the loops, each crossbar position contributing to a resonant frequency of the device.

18. The device of claim 16 wherein each crossbar has a width, each crossbar width contributing to a resonant frequency and a Q factor at that frequency.

19. The device of claim 12 further comprising a second device responsive to a wireless electromagnetic signal and having a plurality of non-equivalent current pathways representing additional information, each of the pathways responding differently to the signal to convey the additional information, wherein the second device comprises a pair of electrically conductive loops and a conductive crossbar sandwiched therebetween, with a dielectric material intervening between the crossbar and the loops, the devices being electrically coupled so as to facilitate joint detection of the information and the additional information.

20. The device of claim 19 wherein the devices are coupled at least capacitively.

21. The device of claim 19 wherein the devices are coupled at least inductively.

22. A method of sensing information, the method comprising:

a. providing a device responsive to a wireless electromagnetic signal and having a plurality of non-equivalent current pathways, each of the pathways responding differently to the signal and collectively representing the information, wherein the device comprises a pair of parallel, electrically conductive elements each patterned to form a single structure having at least two open loops, the elements being electrically connected so as to share a backbone current path and opposed so as to substantially overlap spatially, with a dielectric material sandwiched between the opposed elements;

b. subjecting the device to the wireless electromagnetic signal; and c. recovering the information based on interaction between the device to the signal.

23. The method of claim 22 wherein each of the opposed open loops has an opposite turn direction.

24. The method of claim 22 wherein each of the open loops has a length and an associated resonant frequency dependent on the length, the lengths being different so as to produce different resonant frequencies.

25. The method of claim 22 wherein each of the pathways exhibits a different electrical response to the signal, the responses characterizing the information and differing in at least one of resonant frequency, amplitude, damping, and Q factor.

26. The method of claim 25 wherein each of the pathways corresponds to a different capacitance.

27. The method of claim 25 wherein each of the pathways corresponds to a different inductance.

28. A method of sensing information, the method comprising:

a. providing a device responsive to a wireless electromagnetic signal and having a plurality of non-equivalent current pathways, each of the pathways responding differently to the signal and collectively representing the information;

b. subjecting the device to the wireless electromagnetic signal; and c. recovering the information based on interaction between the device to the signal, wherein the device comprises a plurality of pairs of stacked, electrically conductive elements and:

each element is patterned to form a single structure having at least one open loop;

each pair of elements is electrically connected so as to share a backbone current path;

the elements of each element pair are opposed so as to substantially overlap spatially;

a dielectric material is sandwiched between the elements of each element pair;

the element pairs are electrically coupled without direct connection therebetween; and each element pair exhibits a separately detectable electrical response corresponding to information associated therewith.

29. The method of claim 28 wherein for each pair of elements, the open loops of one of the elements have a first turn direction and the open loops of the other element have a second turn direction opposite to the first turn direction.

30. The method of claim 28 wherein each element comprises a plurality of open loops each having a length and an associated resonant frequency dependent on the length, the lengths being different so as to produce different resonant frequencies.

31. The method of claim 28 wherein the element pairs are coupled at least capacitively.

32. The method of claim 28 wherein the element pairs are coupled at least inductively.

33. The method of claim 28 wherein each of the pathways exhibits a different electrical response to the signal, the responses characterizing the information and differing in at least one of resonant frequency, amplitude, damping, and Q factor.

34. The method of claim 33 wherein each of the pathways corresponds to a different capacitance.

35. The method of claim 33 wherein each of the pathways corresponds to a different inductance.

36. A device responsive to a wireless electromagnetic signal and having a plurality of non-equivalent current pathways representing information, each of the pathways responding differently to the signal to convey the information, wherein the non-equivalent current pathways comprise:

a. a pair of parallel, electrically conductive elements each patterned to form a single structure having at least two open loops, the elements being electrically connected so as to share a backbone current path and opposed so as to substantially overlap spatially; and b. a dielectric material sandwiched between the opposed elements.

37. The device of claim 36 wherein each of the opposed open loops has an opposite turn direction.

38. The device of claim 36 wherein each of the open loops has a length and an associated resonant frequency dependent on the length, the lengths being different so as to produce different resonant frequencies.

39. The device of claim 36 wherein each of the pathways exhibits a different electrical response to the signal, the responses characterizing the information and differing in at least one of resonant frequency, amplitude, damping, and Q factor.

40. The device of claim 39 wherein each of the pathways corresponds to a different capacitance.

41. The device of claim 39 wherein each of the pathways corresponds to a different inductance.

42. A device responsive to a wireless electromagnetic signal and having a plurality of non-equivalent current pathways representing information, each of the pathways responding differently to the signal to convey the information, wherein the non-equivalent current pathways comprise a plurality of pairs of stacked, electrically conductive elements and:

each element is patterned to form a single structure having at least one open loop;

each pair of elements is electrically connected so as to share a backbone current path;

the elements of each element pair are opposed so as to substantially overlap spatially;

a dielectric material is sandwiched between the elements of each element pair;

the element pairs are electrically coupled without direct connection therebetween; and each element pair exhibits a separately detectable electrical response corresponding to information associated therewith.

43. The device of claim 42 wherein for each pair of elements, the open loops of one of the elements have a first turn direction and the open loops of the other element have a second turn direction opposite to the first turn direction.

44. The device of claim 42 wherein each element comprises a plurality of open loops each having a length and an associated resonant frequency dependent on the length, the lengths being different so as to produce different resonant frequencies.

45. The device of claim 42 wherein the element pairs are coupled at least capacitively.

46. The device of claim 42 wherein the element pairs are coupled at least inductively.

47. The device of claim 42 wherein each of the pathways exhibits a different electrical response to the signal, the responses characterizing the information and differing in at least one of resonant frequency, amplitude, damping, and Q factor.

48. The device of claim 47 wherein each of the pathways corresponds to a different capacitance.

49. The device of claim 47 wherein each of the pathways corresponds to a different inductance.

* * * * *